US006021586A

United States Patent [19]

Bucalo et al.

[11] Patent Number: 6,021,586

[45] Date of Patent: Feb. 8, 2000

[54] ADJUSTABLE HEEL ASSEMBLY AND SHOE INCLUDING THE SAME

[76] Inventors: Gladys Lopez Bucalo; Brian D. Bucalo, both of 3600 Mystic Pointe Dr., #1613, Aventura, Fla. 33180

[21] Appl. No.: 09/226,893

[22] Filed: Jan. 7, 1999

Related U.S. Application Data

[63] Continuation-in-part of application No. 08/982,664, Dec. 2, 1997, Pat. No. 5,887,360.

[51] Int. Cl.[7] ..... A43B 21/36; A43B 7/16

[52] U.S. Cl. ..... 36/42; 36/81

[58] Field of Search ..... 36/81, 100, 101, 36/42, 34 R

[56] References Cited

U.S. PATENT DOCUMENTS

| | | | |
|---|---|---|---|
| 2,707,341 | 5/1955 | Romano | 36/42 X |
| 2,767,489 | 10/1956 | Sturman | 36/42 X |
| 3,805,418 | 4/1974 | Matuka et al. | 36/42 X |
| 4,416,072 | 11/1983 | Sarkissian | 36/42 X |
| 4,805,320 | 2/1989 | Goldenberg et al. | 36/42 |
| 5,079,857 | 1/1992 | Clifton | 36/42 |
| 5,887,360 | 3/1999 | Bucalo et al. | 36/42 |

FOREIGN PATENT DOCUMENTS

| | | |
|---|---|---|
| 350445 | 3/1922 | Germany . |

*Primary Examiner*—B. Dayoan
*Attorney, Agent, or Firm*—Steinberg & Raskin, P.C.

[57] ABSTRACT

A shoe having an upper, a sole and an adjustable heel assembly including a first heel member connected to the sole at a rear portion thereof and a second heel member arranged at least partially within the first heel member. The second heel member is movable relative to the first member between a first position in which the first and second heel members provide the heel with a first height and a second position in which the first and second heel members provide the heel with a second height greater than the first height. In the first position of the second heel member, the second heel member is arranged partially within the first heel member whereas in the second position of the second heel member, the second heel member is arranged below the first heel member.

22 Claims, 6 Drawing Sheets

ADJUSTABLE HEEL ASSEMBLY AND SHOE INCLUDING THE SAME

CROSS-REFERENCE TO RELATED APPLICATION

This application is a continuation-in-part of U.S. patent application Ser. No. 08/982,664 filed Dec. 2, 1997, now U.S. Pat. No. 5,887,360.

FIELD OF THE INVENTION

The present invention relates to a shoe having an adjustable heel assembly which enables the shoe to be worn at multiple heel heights and more particularly, to women's high-heel shoes having an adjustable heel assembly which enables an alternative, lower height of the heel.

BACKGROUND OF THE INVENTION

Currently available high-heel shoes for women have a relatively large heel which is fixed to the sole and has a single, predetermined height. This fact has some significant disadvantages for the wearer. In particular, individuals wearing high-heel shoes often experience fatigue or discomfort in their feet because the high heel requires the foot to be bent into an unnatural position. It is also known that prolonged wearing of high-heel shoes can lead to more serious foot problems. Furthermore, some women prefer to wear shoes with relatively low heels at one time of the day, for example, while commuting to work, and then change to shoes with relatively high heels while at work and again back to the shoes with low heels after work.

In order to relieve foot fatigue or discomfort, prevent the development of foot problems or meet personal preferences, a woman is therefore compelled to change from shoes having a relatively high heel to another pair of shoes with a different, lower heel height. It is inconvenient to carry another such pair of shoes and the process of changing shoes is very time consuming.

OBJECTS AND SUMMARY OF THE INVENTION

Accordingly, it is an object of the present invention to avoid the above-mentioned drawbacks of prior art shoes having a heel with a single, predetermined height.

In particular, it is an object of the present invention to provide a shoe with a heel which is adjustable in height thereby avoiding the necessity of carrying additional shoes, special tools, or spare heels of different sizes in order to alter the height of the heel.

It is an additional object of the present invention to provide a shoe which provides a choice of wearing styles for the wearer by permitting an adjustment in the heel height.

In order to attain these objects and others, the adjustable heel assembly for a shoe in accordance with the invention generally comprises two heel members, one of which is arranged at the rear of the downwardly facing surface of and fixed to the body of the shoe, which is usually the sole, and the other of which is movable to at least two positions relative to the fixed member so that in each position, the height of the rear of the body of the shoe is different than the other position(s). The movable heel member is moved between the positions to provide for the desired heel height, e.g., a low heel height during a commute to and from work and a high heel height during work.

The fixed member is an outer heel casing including an interior compartment and the movable member is an inner heel block selectively positionable at least partially within the interior compartment of the outer heel casing. To this end, the inner heel block has an elongate, inwardly extending hole in a peripheral surface. A first elongate, flanged pin is arranged at least partially in the hole, and biasing means are also arranged in the hole for biasing the pin in a direction outward from the hole such that the first pin is situated within the interior compartment of the outer heel casing when the inner heel block is in movement from one position to a second, different position and at least partially outside of the hole when the inmer heel block is in a fixed position. The retraction of the pin against the biasing force enables the inner heel block to be moved relative to the outer heel casing when desired. Furthermore, a first set of at least two vertically spaced apertures may be formed in the outer heel casing, and the hole formed in the peripheral surface of the inner heel block may be brought into alignment with each of the apertures in the outer heel casing.

The heel also includes a second elongate pin arranged at least partially in an additional hole in the inner heel block, and biasing means for biasing the second pin outward from the hole. A second set of at least one aperture is formed in the outer heel casing such that the pin can extend at least partially through the same when in alignment therewith. The second pin is angularly separated from the first pin by at least about 90°, preferably about 180° so that the pins are on opposite sides of the inner heel block. The provision of two pins keeps the inner heel block in perfect parallel alignment with the outer heel casing and prevents tilting and bending of the inner heel block with respect to the outer heel casing under the pounding stress of walking.

If the second set of at least one aperture includes two apertures, the apertures are vertically spaced from one another. When both the first and second pins extend through the respective uppermost apertures in the outer heel casing, the inner heel block remains at a fixed position relative to the outer heel casing in which the heel is at its lowest height and when both the first and second pins extend through the respective lowermost aperture in the outer heel casing, the inner heel block remains at a fixed position in which the heel is at its highest height.

BRIEF DESCRIPTION OF THE DRAWINGS

A more complete appreciation of the present invention and many of the attendant advantages thereof will be readily understood by reference to the following detailed description of the invention when considered in connection with the accompanying drawings in which.

DETAILED DESCRIPTION OF THE PREFERRED EMBODIMENTS

Figure 1:
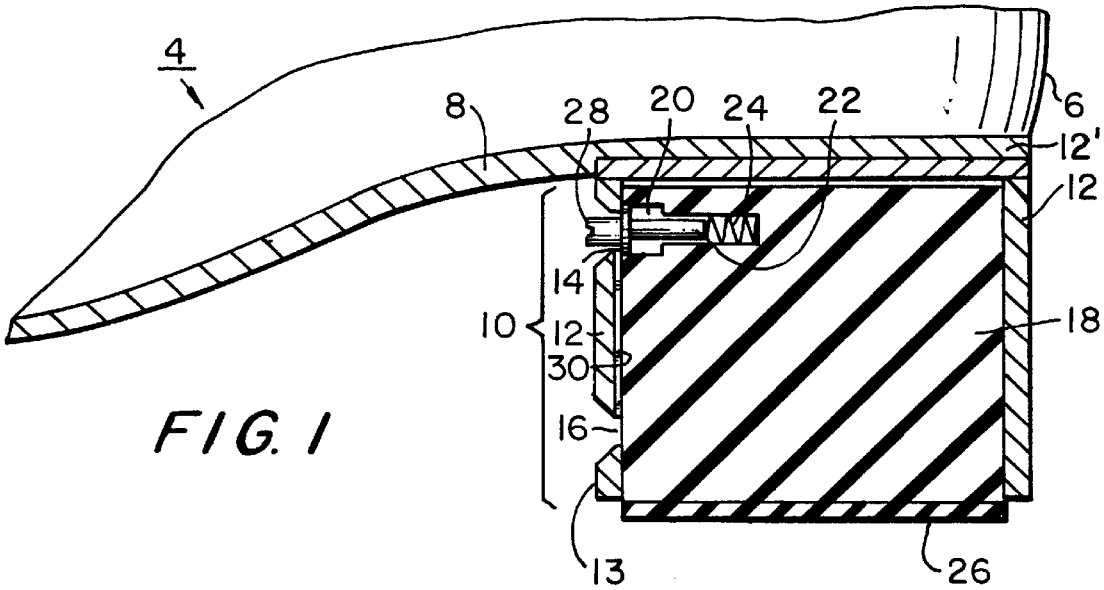
FIG. 1 is a cross-sectional view of a first embodiment of a shoe having an adjustable heel in accordance with the invention wherein the heel has a first height.
Figure 2:
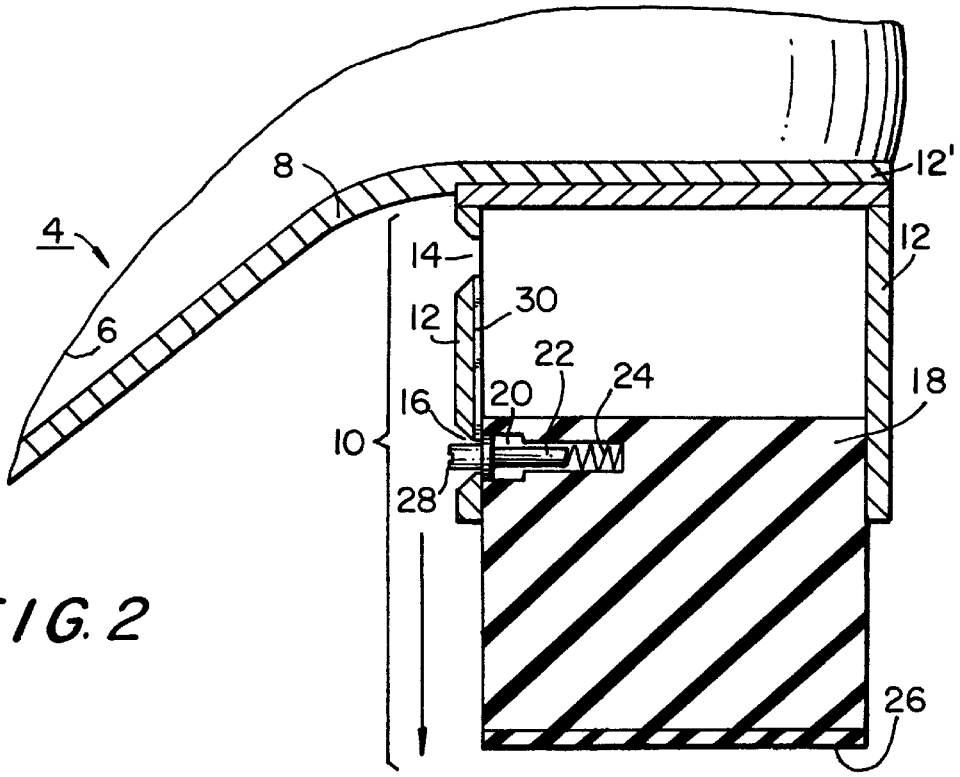
FIG. 2 is a cross-sectional view of the embodiment of the shoe shown in FIG. 1 in which the heel has a second height greater than the first shown in FIG. 1.

Referring to the accompanying drawings wherein like reference characters designate identical or corresponding parts throughout the several views, FIGS. 1 and 2 show a first embodiment of a shoe designated generally as 4 having an adjustable heel assembly in accordance with the invention including an upper 6 and a flexible sole 8 made from typical materials therefor, e.g., a stiff but somewhat flexible material, whereby the upper 6 is arranged in connection with and above the sole 8. The stiffness and flexibility of the sole 8 may vary along different points of its length. The shoe 4 also includes heel assembly 10 in accordance with the invention which comprises a downwardly, oriented outer heel casing 12 defined by walls and a roof section 12' cooperating to provide the desired shape of the heel and which is mounted to the downwardly facing surface of the sole 8. The roof section 12' of the outer heel casing 12 is operatively connected to the inferior surface of sole 8. This connection may be in the form of nails, screws and/or adhesive. A forward facing wall 13 of the outer heel casing 12 has countersunk apertures 14 and 16 vertically spaced from one another and having the same form. Although only two apertures are shown, it is possible to provide more than two apertures to enable additional possible heights of the heel.

The heel assembly 10 also includes a movable inner heel block 18 positionable at least partially within an interior compartment of the outer heel casing 12 as shown in FIG. 1. Inner heel block 18 is defined by walls cooperating to provide a suitable shape for the heel. A portion of the inner heel block 18 extends through an opening in the lower surface of the outer heel casing 12 which will automatically extend for the purpose discussed below. Inner heel block 18 includes a stepped recess or hole 20 formed in a peripheral surface of inner heel block 18, e.g., by drilling, adjacent the forward facing wall 13 of the outer heel casing 12. Stepped hole 20 has a first portion having a first diameter and a second portion having a second diameter greater than the first diameter thereby providing a step between the first and second portions, the second, larger-diameter portion adjoining the peripheral surface of the inner heel block 18. An elongate, flanged pin 22 is arranged within the stepped hole 20 and is pushed forward to extend at least partially through aperture 14 by the action of biasing means such as a spring 24 as shown in FIG. 1. The pin 22 includes a flange in an intermediate position thereon movable in the second portion of the stepped hole 20 whereas the spring 24 is arranged in the first portion of the stepped hole 20. Release of the pin 22 from the stepped hole 20 is prevented by the outward extending flange on the pin 22 which contacts the inner surface of the forward facing wall 13 of the outer heel casing 12 in the extreme extended position (the size of the apertures 14,16 being smaller than the size of the flange on the pin 22).

A rubber heel 26 is arranged on the lower surface of inner heel block 18 and constitutes the lowermost surface of the heel assembly 10 which contacts the ground regardless of the position of the inner heel block 18 relative to the outer heel casing 12.

To adjust the height of the heel assembly 10 from the position shown in FIG. 1 wherein the heel assembly 10 is in its "low" position to the position shown in FIG. 2 wherein the heel assembly 10 is in its "high" position, the pin 22 is pushed inward with the tip of a finger or another pointed object such as a pencil or pen until the pin 22 is entirely within the outer heel casing 12. To this end, a dimple 28 is arranged on the outer surface of the pin 22 and facilitates pushing of pin 22 with a pointed object. As the pin 22 is pushed inward into the stepped hole 20, the spring 24 is compressed. The inner heel block 18 is then manually grasped, e.g., by the rubber heel 26 which projects slightly from the outer heel casing 12, and pulled out of the interior of the outer heel casing 12 thereby extending the inner heel block 18 outside of the outer heel casing 12. Means for guiding the movement of the pin 22 between the apertures 14,16 are provided and comprise a groove 30 formed in the inner surface of the forward facing wall 13 of the outer heel casing 12 extending between the apertures 14,16. The groove 30 serves to guide the pin 22 traveling in a straight line as the inner heel block 18 is moved. The interaction of the groove 30 and the pin 22 also prevents the inner heel block 18 and the outer heel casing 12 from rotating relative to each other. When extending the heel assembly 10, the pin 22 moves in the groove 30 from the aperture 14 and, once the inner heel block 18 reaches a predetermined, desired extended position, it will align with aperture 16. When the pin 22 aligns with the aperture 16, the pin 22 then snaps forward into aperture 16 in view of the extension of the compressed spring 24. The inner heel block 18 is now secured in the extended position.

To return the inner heel block 18 to the "housed" position shown in FIG. 1, the pin 22 is pushed inward until it is entirely within the outer heel casing 12 to thereby compress the spring 24. The inner heel block 18 is then pushed into the interior of the outer heel casing 12. The pin 22 moves in the groove 30 from the aperture 16 until it aligns with aperture 14. When the pin 22 aligns with the aperture 14, the pin 22 then snaps forward into aperture 14 in view of the extension of the compressed spring 24. The inner heel block 18 is now secured in the housed position.

Figure 1A:
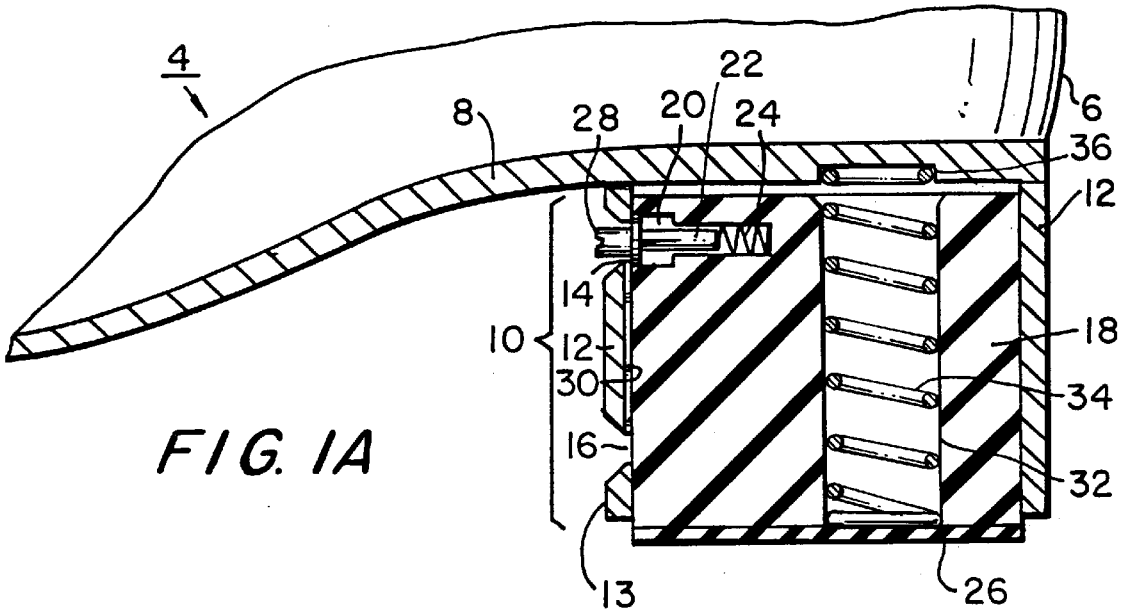
FIG. 1A is a cross-sectional view of a modified embodiment of the shoe shown in FIG. 1 which provides automatic extension of the heel.
Figure 2A:
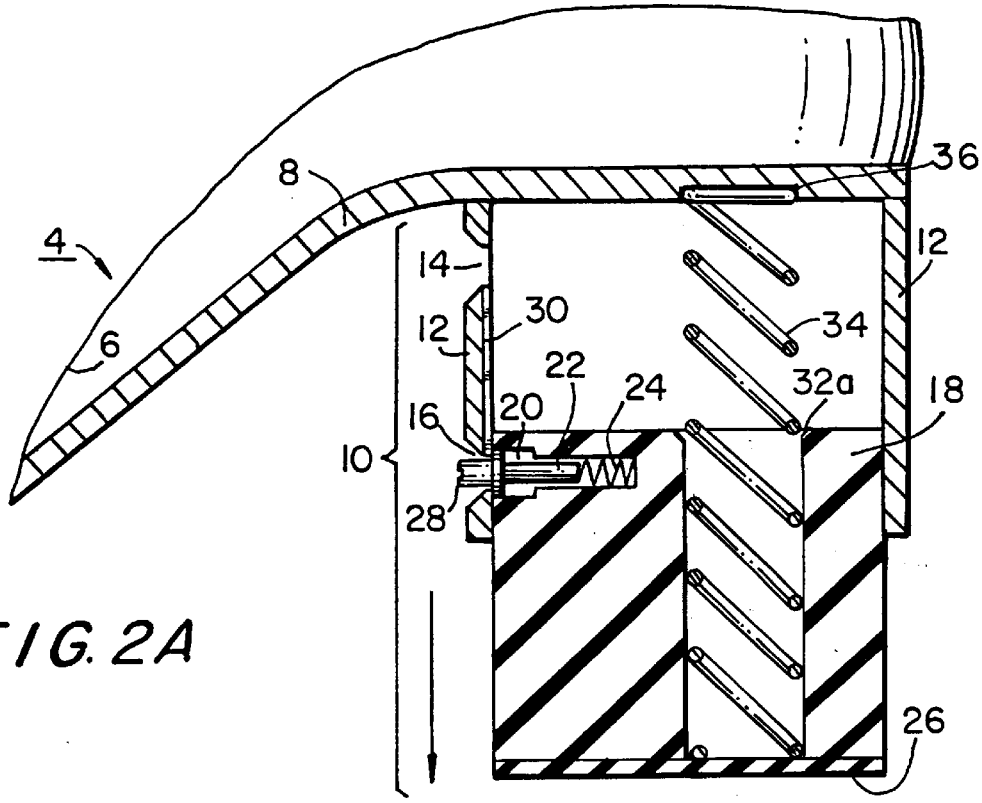
FIG. 2A is a cross-sectional view of the embodiment of the shoe shown in FIG. 1A in which the heel has a second height greater than the first shown in FIG. 1A.

Instead of manually grasping the inner heel block 18 to move the inner heel block 18 to its extended position, one embodiment of the shoe 4 in accordance with the invention includes means for automatically extending the inner heel block 18. In this manner, it is not necessary to grasp a potentially dirty heel. As shown in FIGS. 1A and 2A, one manifestation of such means for automatically extending the inner heel block 18 includes a compression spring 34 arranged inside a vertical channel 32 formed in the inner heel block 18. Vertical channel 32 has rounded edges **32*a* and the spring 34 is placed inside the channel 32 so that one end of the spring 34 is at the bottom of the channel 32, possibly fixedly mounted to the lower wall of the inner heel block 18, and the other end of the spring 34 is snugly press-fitted into a recess 36 formed in the lower surface of the sole 8, and also possibly fixedly mounted thereto. When the heel assembly 10 is in its "low" position, the spring 34 is compressed thereby exerting a force to push the inner heel block 18 outward. However, in the position shown in FIG. 1A, the inner heel block 18 is restrained and prevented from extending outward by the interference of the pin 22 extending through the aperture 14**.

To adjust the height of the heel assembly 10 from the position shown in FIG. 1A wherein the heel assembly 10 is in its "low" position to the position shown in FIG. 2A wherein the heel assembly 10 is in its "high" position, the pin 22 is pushed inward until it is entirely within the outer heel casing 12. As such, the restraint provided by the extension of the pin 22 through aperture 14 on the force exerted by the spring 34 to push the inner heel block 18 outward is eliminated and thus, the inner heel block 18 is then free to automatically extend outside of the outer heel casing 12 by the force exerted by the compressed spring 34. The groove 30 serves to guide the pin 22 in its automatic extension in a straight line as the inner heel block 18 is automatically forced outward of the outer heel casing 12. When extending the heel assembly 10, the pin 22 moves in the groove 30 from the aperture 14 and, once the inner heel block 18 reaches a predetermined, desired extended position, it will align with aperture 16. When the pin 22 aligns with the aperture 16, the pin 22 then snaps forward into aperture 16 in view of the extension of the compressed spring 24. The inner heel block 18 is now secured in the extended position.

Other comparable arrangements whereby the inner heel block 18 is automatically extended from the outer heel casing 12, i.e., without requiring manual contact of the inner heel block 18, can also be used in the invention without deviating from the scope and spirit thereof.

To return the inner heel block 18 to the housing position shown in FIG. 1, the pin 22 is pushed inward until it is entirely within the outer heel casing 12 to thereby compress the spring 24. By stepping on the shoe 4, the inner heel block 18 is then pushed into the interior of the outer heel casing 12 against the force of the spring 34 thereby compressing the same. The pin 22 moves in the groove 30 from the aperture 16 until it aligns with aperture 14. When the pin 22 aligns with the aperture 14, the pin 22 then snaps forward into aperture 14 in view of the extension of the compressed spring 24. The inner heel block 18 is now secured in the housed position.

The spring 34 could also be configured to store energy while under tension instead of compression. This would permit the inner heel block 18 to be automatically retracted instead of extended.

Figure 1B:
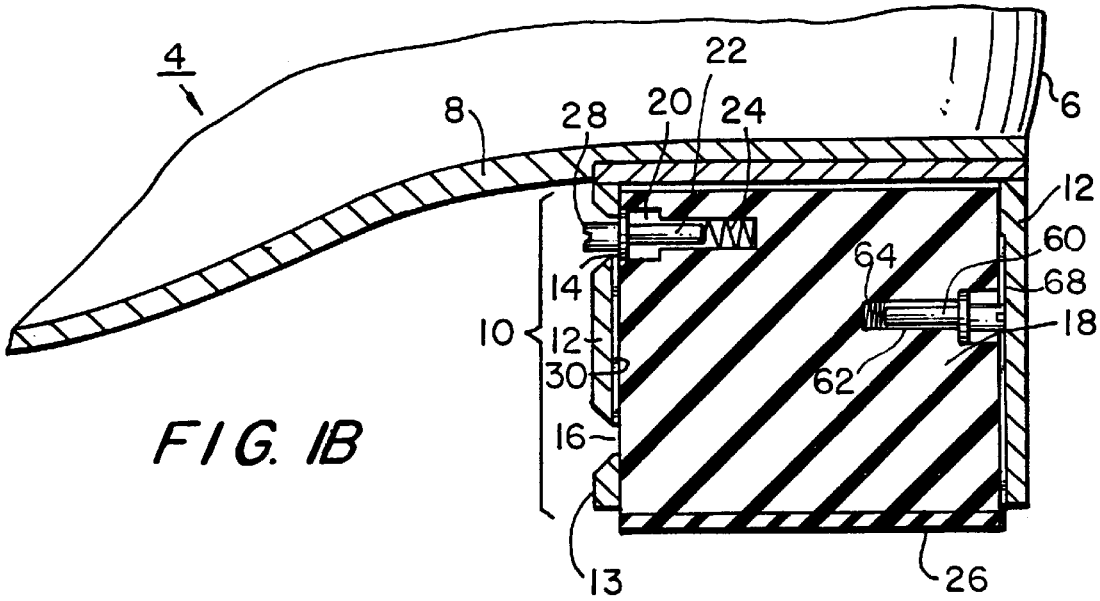
FIG. 1B is a cross-sectional view of another modified embodiment of the shoe shown in FIG. 1.
Figure 2B:
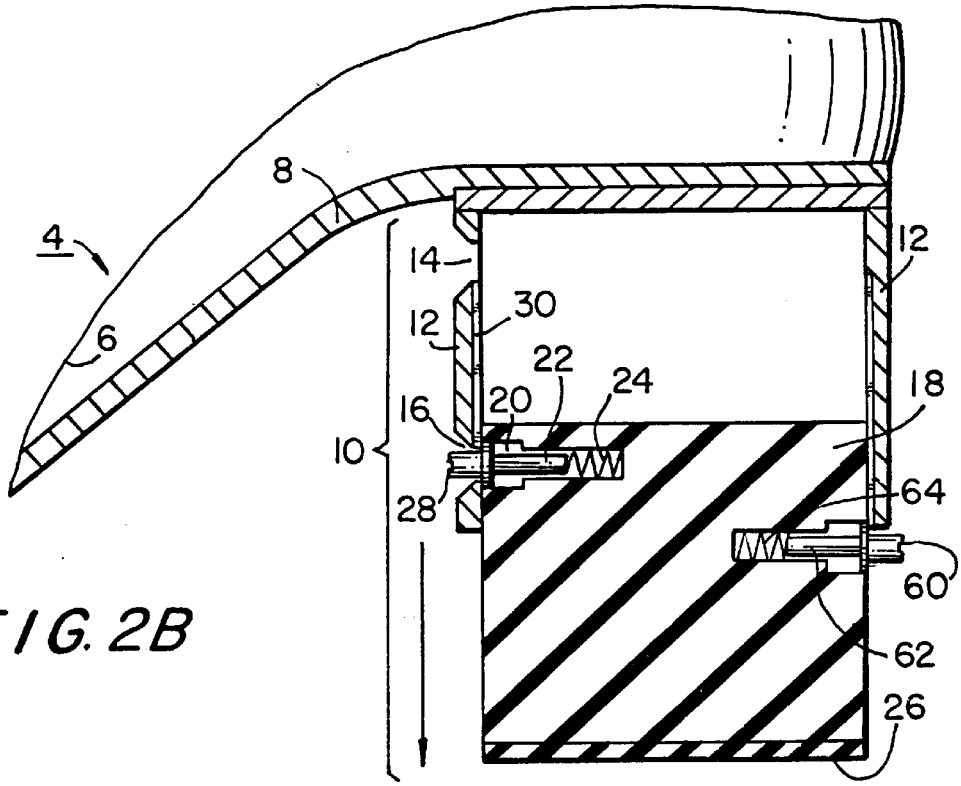
FIG. 2B is a cross-sectional view of the embodiment of the shoe shown in FIG. 1B in which the heel has a second height greater than the first shown in FIG. 1B.

FIGS. 1B and 2B show a modified embodiment of the heel assembly 10 shown in FIG. 1. In this embodiment, the heel assembly 10 includes a second elongated, flanged pin 60 arranged in the inner heel block 18 at a different location around the periphery of the inner heel block 18 than the location at which the first pin 22 is situated. Preferably, the second pin 60 is located on the opposite side of the heel block 18 from the first pin 22, i.e., forming a 180° angle between the pin locations (although any angle including a 90° angle between pin locations is possible). Pin 60 is arranged at least partially in a recess or hole 62 formed in the peripheral surface of the inner heel block 18. Biasing means such as a biasing spring 64 are arranged at least partially in the hole 62 and urge the pin 60 in a direction outward from the hole 62. In contrast to the presence of apertures 14,16 in the forward facing wall 13 of the outer heel casing 12 to receiving a portion of the pin 22, apertures arc not arranged in the wall defining the outer heel casing 12 to receive the pin 60. Rather, when the inner heel block 18 is in its retracted position shown in FIG. 1B, the pin 60 is substantially entirely within the hole 62 and does not project outward from the heel casing 12. As the inner heel block 18 is extended downward, the forward edge of pin 60 slides in a vertical groove 68 formed along the inner wall of outer heel casing 12 until the inner heel block 18 has extended sufficiently such that the pin 60 is urged outward from the hole 62 by the biasing spring 64 to the position shown in FIG. 2B. In this position, the outer heel casing 12 rests on the pin 60 while complete removal of the pin 60 from hole 62 is prevented by the flange on pin 60 which abuts against the bottom wall of outer heel casing 12.

The location of the holes 18,62 and aperture 16 are preferably selected so that the while pin 60 is in its extended position partially outside of hole 62, pin 22 is also in its extended position extending partially though aperture 16. In this manner, a more secure extension of inner heel block 18 is obtained. To return the inner heel block 18 into the outer heel casing 12, both pins 22,60 must be pushed inward while the inner heel block 18 is urged upward. This requirement for the application of two forces and on opposite sides of the heel assembly 10 serve to more adequately prevent inadvertent and accidental retraction of the inner heel block 18 into the outer heel casing 12.

Although both pins 22 and 60 are shown in the embodiment of FIGS. 1B and 2B, pin 60 may be used in a heel assembly 10 in accordance with the invention without pin 22.

Figure 1C:
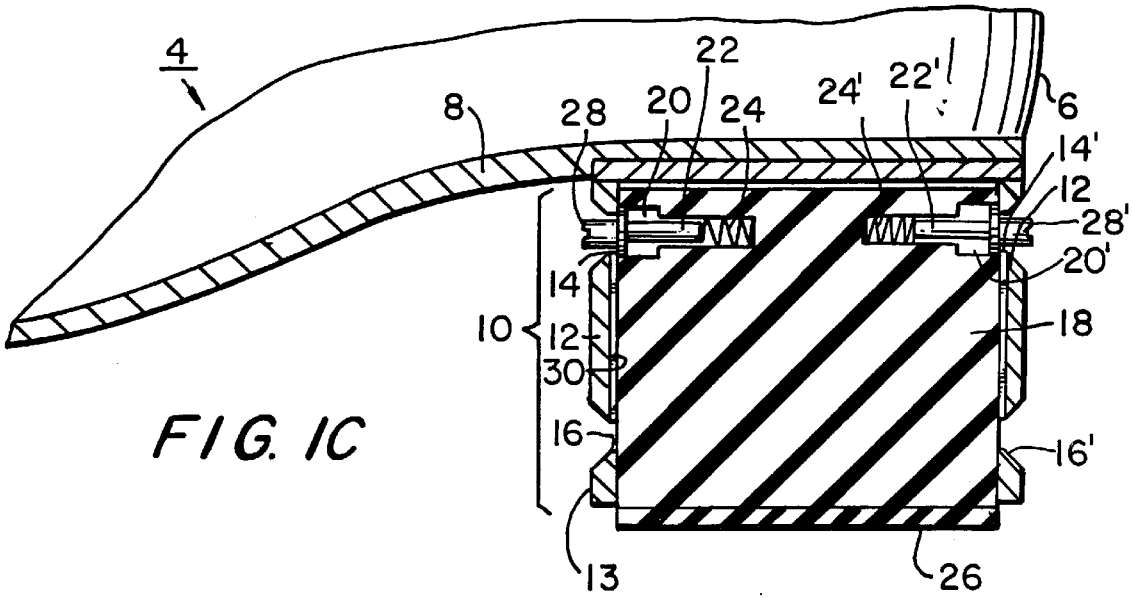
FIG. 1C is a cross-sectional view of another modified embodiment of the shoe shown in FIG. 1.
Figure 2C:
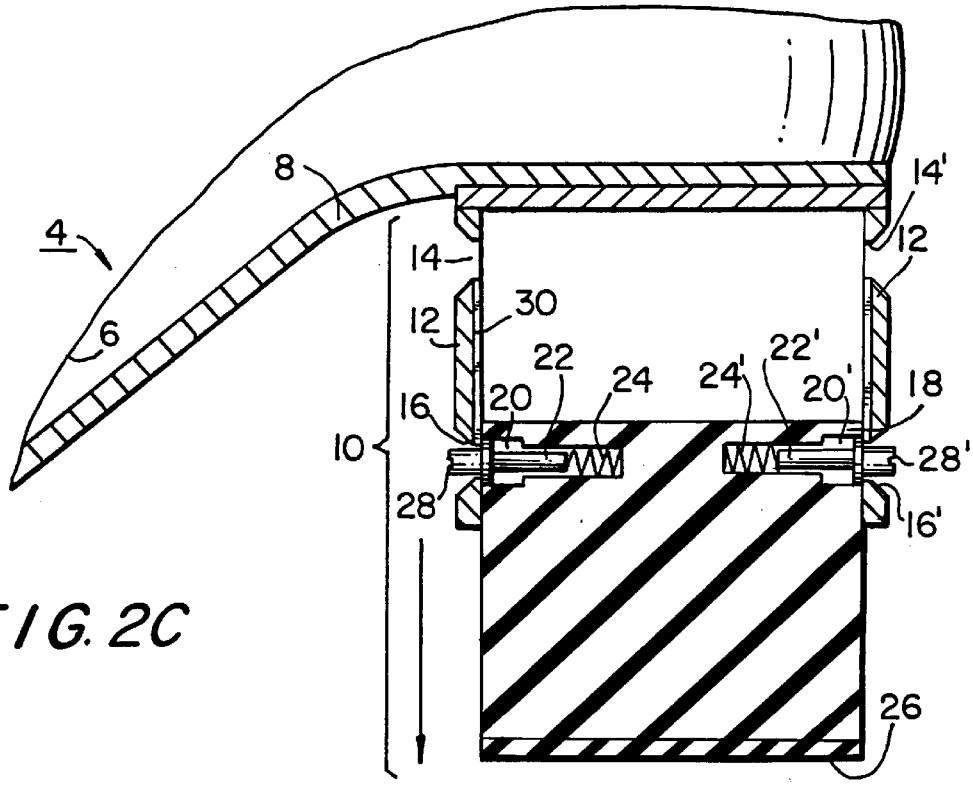
FIG. 2C is a cross-sectional view of the embodiment of the shoe shown in FIG. 1C in which the heel has a second height greater than the first shown in FIG. 1C.

FIGS. 1C and 2C show an embodiment wherein the inner heel block 18 houses an additional elongate, flanged pin 22' and thus includes a second stepped hole 20' formed in the peripheral surface thereof. The outer heel casing 12 has additional countersunk apertures 14', 16' vertically spaced from one another at a location opposite the location of apertures 14,16. Stepped hole 20' has a similar construction as stepped hole 20 discussed above. Pin 22' is arranged within the stepped hole 20' and is pushed forward to extend at least partially through aperture 14' by the action of biasing means such as a spring 24' arranged in the hole 20'. Release of the pin 22' from the stepped hole 20' is prevented by the outward extending flange on the pin 22' which contacts the inner surface of the outer heel casing 12 in the extreme extended position (the size of the apertures 14', 16' being smaller than the size of the flange on the pin 22'). Apertures 14',16' may be arranged at the same height levels as apertures 14,16, respectively. Pin 22' has a dimple 28' on an outer surface thereof.

The provision of a second pin 22' keeps the inner heel block 18 in parallel alignment with the outer heel casing 12 and prevents tilting and bending of the inner heel block 18 with respect to the outer heel casing 12 under the pounding stress of walking.

FIGS. 3–6 illustrate a second embodiment of the invention in which the shoe designated generally as 37 includes an upper 38 and a flexible sole 40 made from a stiff but flexible material and a heel assembly 42 in accordance with the invention. Heel assembly 42 comprises a heel 44 fixed to the sole 40 and having a first forward section 44*a* and a second rear section 44*b* and defining a hollow storage compartment 46 in its mid section between the forward and rear sections 44*a*,44*b*. Heel 44 is defined by outer walls cooperating to provide the desired shape of the heel or a solid block having a form of the desired shape of the heel. Forward and rear sections 44*a*,44*b* may be connected to one another or separated from one another. Storage compartment 46 contains a heel extension member 48 attached to the fixed heel 44 via a hinge 50. Heel extension member 48 is defined by walls cooperating to provide a desired shape for the heel or a solid block having a form of the desired shape of the heel.

Figure 5:
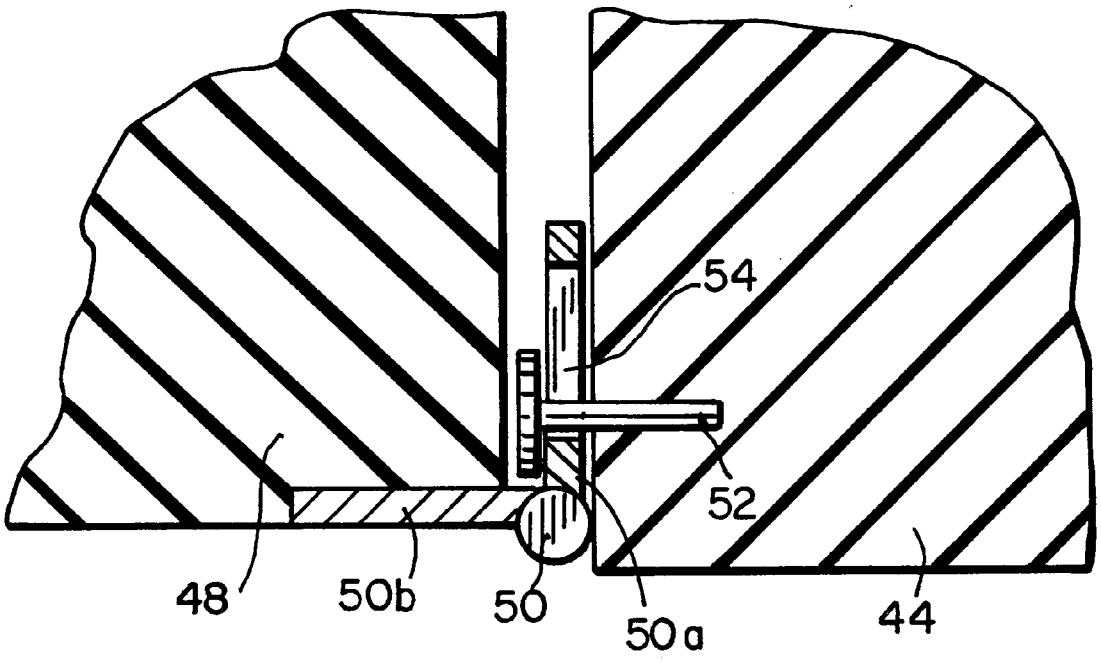
FIG. 5 is an enlarged view of the circle labeled 5 in FIG. 3.
Figure 6:
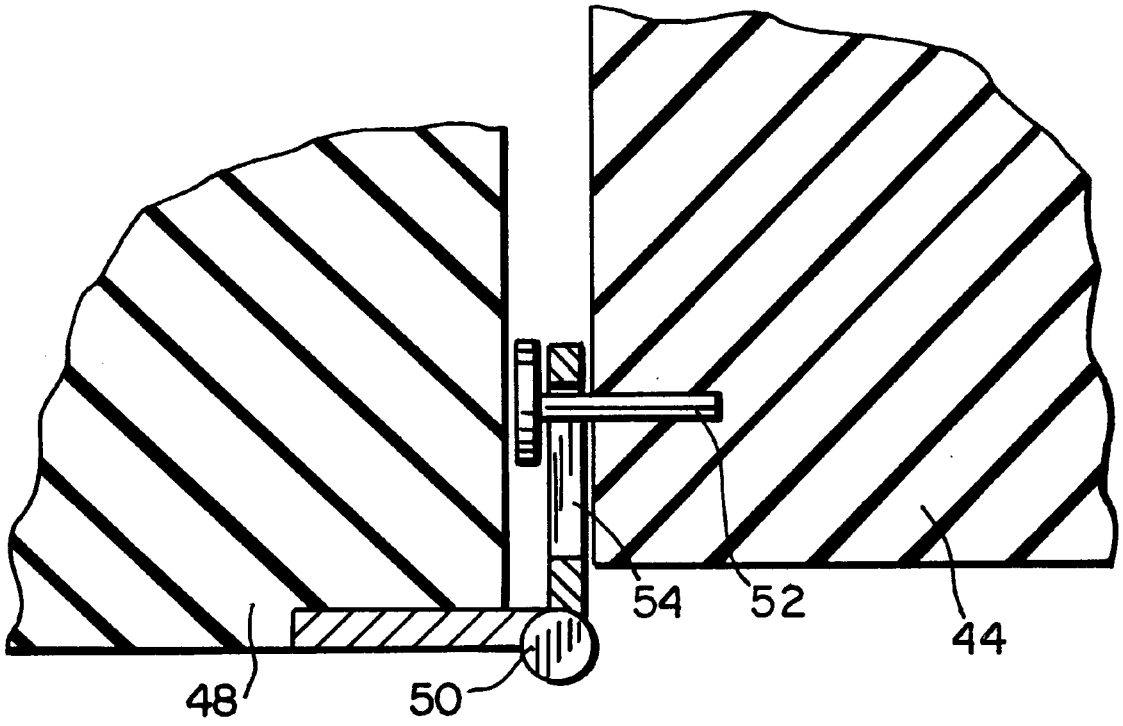
FIG. 6 is a view similar to FIG. 5 showing the heel extension member ready to be moved into the extended position.

As shown in FIG. 5, hinge 50 comprises a first substantially planar plate 50*a* adjacent to the fixed heel 44 and coupled thereto via a pin 52 and a second substantially planar plate 50*b* attached to the heel extension member 48. Pin 52 extends through a vertical slot 54 in the hinge plate 50*a* and is inserted into the fixed heel 44. The pin 52 is movable relative to slot 54, i.e., the hinge 50 is movable relative to the pin 52 which is fixedly connected to the fixed heel 44.

Figure 3:
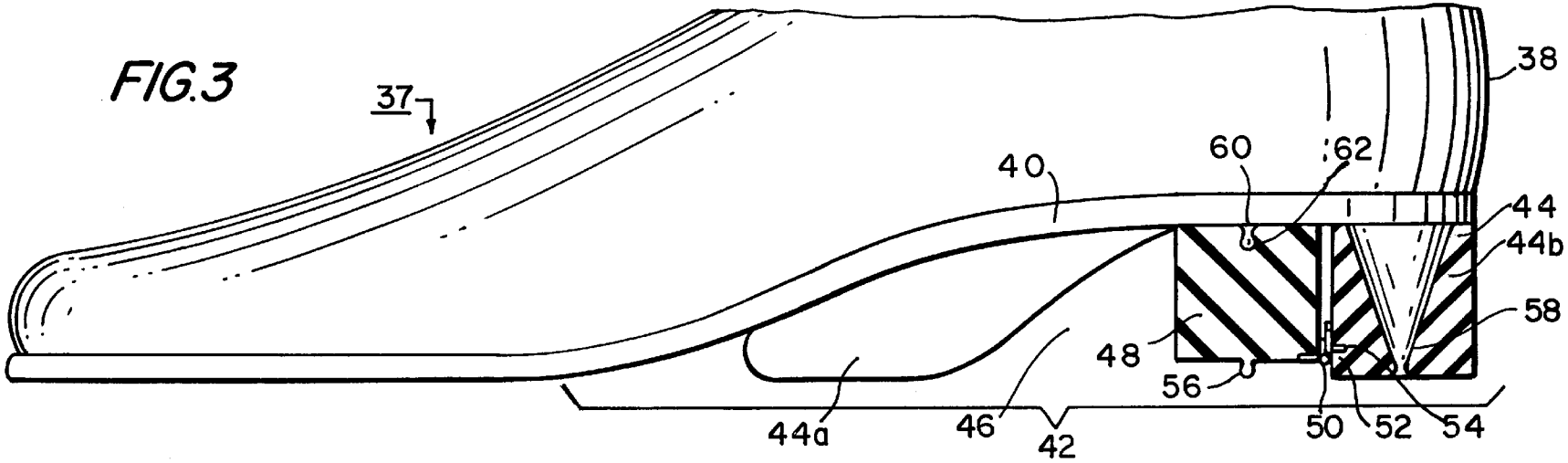
FIG. 3 is a cross-sectional view of a second embodiment of a shoe having an adjustable heel in accordance with the invention wherein the heel has a first height.
Figure 4:
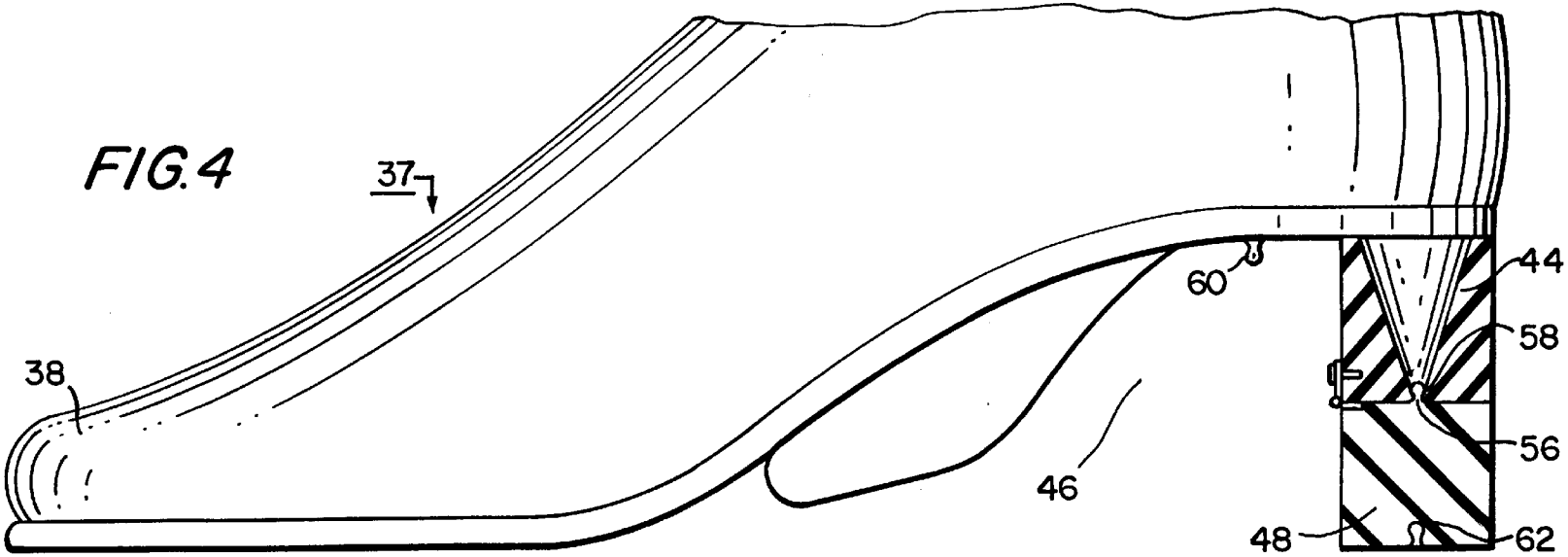
FIG. 4 is a cross-sectional view of the embodiment of the shoe shown in FIG. 3 in which the heel has a second height greater than the first shown in FIG. 3.

Referring to FIGS. 3 and 4, a male snap pin 56 is arranged on the lower surface of heel extension 48 and is set at a level so as not to protrude below the lower surface of the fixed heel 44. Another male snap pin 60 is arranged on sole 40 and mates with a female snap receptacle 62 in the upper surface of the heel extension member 48 thereby holding the heel extension 48 within storage compartment 46 until needed, i.e., until the wearer desires to extend the height of the heel assembly 42. Male snap pin 60 and female snap receptacle 62 may alternatively be located on opposing surfaces of the heel extension member 48 and fixed heel 44 when the heel extension member 48 is situated within the storage compartment 46.

To extend the heel, heel extension 48 may be grasped to separate snap pin 60 from the snap receptacle 62 and then rotated outward from storage compartment 46. In conjunction therewith, hinge 50 slides from the position shown in FIG. 5 downward to a lower position shown in FIG. 6 by virtue of the slidability of pin 52 in vertical slot 54. This permits the pivot point of hinge 50 to be adjusted vertically up and down thereby facilitating the mating of the heel extension 48 with the fixed heel 44 vis-a-vis cooperating engagement means 56,58 (discussed below). Alternatively, the hinge 50 may comprise a flexible sheet material such as film or cloth, a wire or a chain thereby providing the necessary 'play' to permit easy mating of the fixed heel 44 and the heel extension 48. FIG. 4 illustrates the embodiment of FIG. 3 with the heel extension 48 rotated outward from the storage compartment 46 and mated with the fixed heel 44.

Locking means are provided for securely attaching the heel extension member 48 to the fixed heel 44 when the heel is at the high height, i.e., the height provided by the combination of the fixed heel 44 and the heel extension member 48, and in the illustrated embodiment comprise a snap pin 56 which mates with a cooperating receptacle 58. Receptacle 58, located within the fixed heel 44, is in the form of a cavity having a narrow opening at its lower end and an upper end having a larger cross-sectional area than the lower end. This geometry for the receptacle 58 serves to prevent bits of street sand or grit from jamming or clogging the narrow opening of the receptacle 58 since sand or grit would easily be pushed into the wider upper portion of the receptacle 58 by the mating action of the male snap pin 56. In view of this construction, a secure but releasable attachment between the fixed heel 44 and the heel extension 48 is provided.

FIG. 5 is an enlarged side view of the hinge 50, pin 52, vertical slot 54, fixed heel 44, and heel extension 48 in a position in which the snap pin 60 is situated within snap receptacle 62. When the snap pin 60 separates from snap receptacle 62, hinge 50 is able to slide downward to the position shown in FIG. 6. This lowering of the pivot point of hinge 50 prevents interference between the mating surfaces of fixed heel 44 and heel extension 48.

The examples provided above are not meant to be exclusive. Many other variations of the present invention would be obvious to those skilled in the art, and are contemplated to be within the scope of the appended claims. For example, it is pointed out that the invention is useful and applicable for all shoes having heels, not only to women's high-heel shoes. The heels in accordance with the invention can be incorporated into the shoes during the manufacturing of the shoes or possibly incorporated therein as a replacement for a conventional heel. In the embodiment shown in FIGS. 1 and 2, instead of the stepped hole and flanged pin, other types of biased members may be installed in the inner heel block 18 so long as movement of the inner heel block 18 is selectively enabled.

We claim:

1. A shoe comprising a sole, an upper arranged in connection with and above said sole, and a heel arranged below said sole, said heel comprising a first, downwardly oriented heel member arranged at a rear portion of and connected to said sole, said first heel member having an interior compartment, a second heel member arranged in connection with said first heel member, said second heel member being movable relative to said first member between a first position in which said first heel member and said second heel member provide the heel with a first height and a second position in which said first heel member and said second heel member provide the heel with a second height greater than the first height, said second heel member when in said first position being positionable at least partially within said interior compartment of said first heel member, said first heel member having a first set of at least two vertically spaced apertures and said second heel member having a first elongate, inwardly extending hole in a peripheral surface, an elongate pin arranged in said first hole, and biasing means for biasing said pin arranged in said first hole in a direction outward from said first hole such that said pin arranged in said first hole is at least partially outside of said first hole and extends through a respective one of said at least two apertures in said first set when said second heel member is in said first and second positions.

2. The shoe of claim 1, wherein said first heel member has a second set of at least two apertures and said second heel member has a second hole in the peripheral surface alignable with each of said apertures in said second set, further comprising a second pin arranged in said second hole, and second biasing means for biasing said second pin outward from said second hole and at least partially through one of said apertures in said second set in said first heel member when said second pin is in alignment with said aperture.

3. The shoe of claim 2, wherein said first and second holes are arranged on opposite sides of said second heel member and said first and second sets of apertures are arranged on opposite sides of said first heel member.

4. The shoe of claim 1, wherein said first heel member has a single, additional aperture and said second heel member has a second hole in the peripheral surface alignable with said additional aperture, further comprising a second pin arranged in said second hole, and second biasing means for biasing said second pin outward from said second hole and at least partially through said additional aperture in said first heel member when said second pin is in alignment with said additional aperture.

5. The shoe of claim 1, wherein said first hole is a stepped hole having a first portion having a first diameter and a second portion having a second diameter greater than the first diameter, said pin arranged in said first hole including a flange in an intermediate position thereon movable in said second portion of said first hole, said biasing means for biasing said pin arranged in said first hole being arranged at least partially in said first portion of said first hole.

6. The shoe of claim 1, wherein said first heel member includes guide means for guiding the movement of said second heel member.

7. The shoe of claim 6, wherein said guide means comprise at least one vertical groove arranged on an inner face of said first heel member.

8. The shoe of claim 2, wherein said first heel member includes guide means for guiding the movement of said second heel member, said guide means comprising a first vertical groove arranged on an inner face of said first heel member in which said first pin is slidable and a second vertical groove arranged on the inner face of said first heel member in which said second pin is slidable.

9. The shoe of claim 8, further comprising means for automatically moving said second heel member from said first position to said second position.

10. The shoe of claim 1, further comprising means for automatically moving said second heel member from said first position to said second position.

11. The shoe of claim 10, wherein said means for automatically moving said second heel member comprise a spring operatively connecting said first heel member and said second heel member, said spring being structured and arranged to provide a force which acts to move said second heel member relative to said first heel member.

12. A shoe comprising a sole, an upper arranged in connection with and above said sole, and a heel aranged below said sole, said heel comprising a first, downwardly oriented heel member arranged at a rear portion of and connected to said sole, said first heel member having an interior compartment, a second heel member positionable at least partially within said interior compartment of said first heel member, and displacement means for enabling displacement of said second heel member relative to said first member such that said second heel member is movable between a first position in which said first heel member and said second heel member provide the heel with a first height and a second position in which said first heel member and said second heel member provide the heel with a second height greater than the first height, said displacement means comprising said first heel member having a first set of at least two vertically spaced apertures, said second heel member having a first elongate, inwardly extending hole in a peripheral surface, an elongate pin arranged in said first hole, and biasing means for biasing said pin arranged in said first hole in a direction outward from said first hole such that said pin arranged in said first hole is at least partially outside of said first hole and extends through a respective one of said apertures in said first set when said second heel member is in said second position.

13. The shoe of claim 12, wherein said second heel member is arranged at least partially within said interior compartment of said first heel member when in said first position.

14. The shoe of claim 12, wherein said first heel member has a second set of at least two vertically spaced apertures and said second heel member has a second hole in the peripheral surface alignable with each of said apertures, said displacement means further comprising a second pin arranged in said second hole, and second biasing means for biasing said second pin outward from said second hole and at least partially through one of said apertures in said second set in said first heel member when said second pin is in alignment with said aperture.

15. The shoe of claim 14, wherein said first and second holes are arranged on opposite sides of said second heel member.

16. The shoe of claim 12, wherein said first hole is a stepped hole having a first portion having a first diameter and a second portion having a second diameter greater than the first diameter, said pin arranged in said first hole including a flange in an intermediate position thereon movable in said second portion of said first hole, said biasing means for biasing said pin arranged in said first hole being arranged at least partially in said first portion of said first hole.

17. The shoe of claim 12, wherein said first heel member includes guide means for guiding the movement of said second heel member.

18. The shoe of claim 17, wherein said guide means comprise a vertical groove arranged on an inner face of said first heel member.

19. The shoe of claim 18, wherein said first pin is slidable in said vertical groove.

20. The shoe of claim 12, further comprising means for automatically moving said second heel member from said first position to said second position.

21. The shoe of claim 20, wherein said means for automatically moving said second heel member comprise a spring operatively connecting said first heel member and said second heel member, said spring being structured and arranged to provide a force which acts to move said second heel member relative to said first heel member.

22. A heel for a shoe comprising a first, downwardly oriented heel member arranged at a rear portion of and connected to said sole, said first heel member having an interior compartment, a second heel member arranged in connection with said first heel member, said second heel member being movable relative to said first member between a first position in which said first heel member and said second heel member provide the heel with a first height and a second position in which said first heel member and said second heel member provide the heel with a second height greater than the first height, said second heel member when in said first position being positionable at least partially within said interior compartment of said first heel member, said first heel member having a first set of at least two vertically spaced apertures and said second heel member having a first elongate, inwardly extending hole in a peripheral surface, a elongate pin arranged in said first hole, and biasing means for biasing said pin in a direction outward from said first hole such that said pin is at least partially outside of said first hole and extends through a respective one of said at least two apertures in said first set when said second heel member is in said first and second positions.

* * * * *